US006158077A

United States Patent [19]

Wenger et al.

[11] Patent Number: 6,158,077

[45] Date of Patent: Dec. 12, 2000

[54] PERSONAL HYGIENE APPLIANCE

[76] Inventors: William K. Wenger, 600 Harbor Blvd., #944, Weehawken, N.J. 07087; Sandra T. Pierre, R.R. #5, Box 5076-A, Moscow, Pa. 18444

[21] Appl. No.: 09/219,037

[22] Filed: Dec. 23, 1998

[51] Int. Cl.[7] ..... A47K 10/16

[52] U.S. Cl. ..... 15/210.1; 15/145; 294/100

[58] Field of Search ..... 15/210.1, 145, 15/149, 154; 294/100; 604/1, 15, 18

[56] References Cited

U.S. PATENT DOCUMENTS

| | | | |
|---|---|---|---|
| 2,666,224 | 1/1954 | Adams | 15/201.1 |
| 2,947,564 | 8/1960 | Winther | 294/100 |
| 4,865,030 | 9/1989 | Polyak | 294/100 |
| 4,987,634 | 1/1991 | Weihrauch | 15/145 |
| 5,875,512 | 3/1999 | Lanthan | 15/210.1 |

FOREIGN PATENT DOCUMENTS 897556 5/1962 United Kingdom .

*Primary Examiner*—Robert J. Warden, Sr.
*Assistant Examiner*—Kaj K. Olsen
*Attorney, Agent, or Firm*—Bruce & McCoy

[57] ABSTRACT

A personal hygiene appliance extension handle for persons having limited hand reach or body mobility which has a grasping means for holding toilet tissue and functions as a hand extension to permit cleansing of the perineal area.

4 Claims, 2 Drawing Sheets

PERSONAL HYGIENE APPLIANCE

BACKGROUND OF THE INVENTION

1. Field of the Invention

The present invention relates to a personal hygiene appliance which functions as a hand extension. More particularly, it relates to a hand-held appliance for use when cleaning the perineal area. Still more particularly, the present invention relates to a hand-held appliance formed for grasping a disposable cleaning tissue, such as toilet paper, and facilitating extension of the tissue by the appliance to the perineal area of the body.

2. Background of the Invention

One of the indignities which a person can experience is the inability to cleanse oneself in the perineal area as a result of an unanticipated or uncorrectable condition such as arthritis, physical impairment, overweight, short arms, injury to the back, and other developments which prevent a person from effectively reaching the perineal area with either hand. When it is not possible to properly cleanse oneself after defecating or urinating, personal hygiene suffers. Sometimes a second person, such as a family member or a hired caregiver, is required to do the cleaning. Either situation is unpleasant for the parties concerned, and is humiliating for the person who requires assisted cleaning. An appliance is needed to solve the problems involved which allows a person to reach and clean the perineal area of the body after waste elimination.

The few devices available for the purpose of assisting a person in personal cleansing at the toilet are difficult to manipulate and generally are not adapted to the body contours in the perineal area. Known devices are essentially provided for the purpose of grasping a wad of toilet paper. Uniformly, the handles of these devices position the hand in an orientation that is incompatible with the hand orientation normally required to clean the perineal area. The required positioning of the hand to manipulate such a device is awkward, hard to learn or perform, and does not benefit from the motor skills and habits developed during the earlier years of one's learning experience. Generally, a clump of toilet paper is held by a device, but it is not optimal for personal cleaning of the perineal area of the body. As a result, more time and effort and frustration must be expended by a person in the cleaning process. In addition to the extra time spent on preparing the toilet paper for securement onto the device, it can be difficult and messy removing soiled toilet paper from the device. Usually, in order for the device to operate effectively and be comfortable, more toilet paper is used than when using a hand. This increases cost and places additional demands on plumbing and on the sewage treatment or septic tank environment due to the extra toilet paper required.

A disadvantage of conventional toilet paper for some persons and conditions is that it is not as efficient in those cases for cleaning the perineal area as is a premoistened cloth or towelette. Premoisturized tissues or wipes, marketed commercially as "Wash 'n Dri, Nice 'n Clean, Chubs, Softkins, Pop-Ups, Scott Fresh, and Cottonelle Flusbable Moist Wipes, are considered by some persons to be more efficient for cleaning the perineal area, and they could be used in conjunction with the devices previously described. However, the wipes cannot be held in a manner that is optimal for cleaning since they usually come in small individual sheets. A long strip of toilet paper is normally wrapped around a tongs or clamp to provide bulk and cushioning from the hard tip of either device, but individual premoistened sheets cannot be used in this manner.

In order to solve these problems, a hand extension is required which is universal and can grip and comfortably apply either a single sheet of premoisturized material or several sheets of conventional toilet paper to the perineal area for cleaning after elimination. The premoistened wipe or toilet paper is temporarily secured by a cleaning head on a hand extension for the purpose of cleaning the perineal area by people who have limited reach, hand strength, or range of motion. The extension at one end accommodates the hand in a natural position consistent with cleaning the perineal area, and at the opposite end incorporates a cleaning head consisting of a formed flexible structure that grips a single sheet of premoistened material or several sheets of conventional toilet paper and brings this material into comfortable and effective contact with the area being cleaned and which permits simple and clean extraction of the soiled tissue or wipe from the device without the possibility or need of contacting the soiled portion of the tissue or wipe.

In summary, the present invention relates to a hand extension consisting of a curved handle with a hand grip at one end and a flexible structure, or cleaning head, at the opposite end for temporarily securing toilet paper or a premoisturized sheet of disposable and preferably flushable material. The present invention will aid people having limited range of motion or reach due to disability, back injury, age, body size, and other conditions which hinder or prevent a person from reaching and cleaning the perineal area after defecation or urination.

DESCRIPTION OF THE PRIOR ART

As previously stated briefly in the description of the background of the invention of this specification, prior art devices for assisting in cleaning of the perineal area of a person are not specifically designed for the purpose and are generally based on clamp, tong, or hook configurations. The operative end of these existing devices is not shaped to conform to the human body and is usually constructed of a rigid material such as metal or plastic. To use any of these devices, generally an extended strip of toilet paper is secured to the operative end of the device and then wrapped around the end to form a clump. Also, the toilet paper may be folded and gripped within the jaws of tongs or a clamp. Generally, devices currently on the market for cleaning the perineal area are found in stores and catalogs that specialize in the needs of people who may be physically challenged due to injury or illness.

The operative ends of the prior art devices which hold the cleaning material are not contoured to fit the human body and are fabricated of rigid material which could injure the body if used improperly. To offset the rigid and nonconforming shapes of prior art devices, significant amounts of toilet paper must be used to provide any cushioning. Thus, little of the toilet paper used in this manner is available for actual cleaning of the person. The rigidity and shapes of prior art devices do not provide psychological comfort to people who have need for such a device. Since they don't look comfortable to use, people who would otherwise benefit from such a device avoid using them and become dependent on family members or professional caregivers for perineal cleaning.

SUMMARY OF THE INVENTION

The present invention is a personal hygiene appliance for persons having limited hand reach or body mobility. The appliance functions as a hand extension to permit persons to clean their perineal area with a firmly grasped tissue paper at an extended position from the hand after defecation or urination. The appliance is comprised of an extension handle having formed at a first end thereof a hand grip which permits the appliance to be grasped firmly without undue effort to prevent twisting. It also permits a natural hand position for accurately orienting and positioning the tissue paper proximate the perineal area prior to contact therewith. The extension handle has formed at the second end thereof a means for grasping the tissue paper and supporting it during contact with the perineal area without hand squeezing or digital manipulation and in a manner which prevents the paper from being pulled out of the appliance during the cleaning of the perineal area in the event a portion of the human body surrounding the perineal area inadvertently experiences closure upon the tissue and tends to extract the tissue from the appliance. The second end also is formed to support at least a single sheet of the tissue paper spread in a generally rounded configuration to enhance full contact of the perineal area by said tissue paper during the cleaning operation.

OBJECTS OF THE INVENTION

It is therefore an important object of the present invention to provide a personal hygiene hand extension appliance for persons who have limited hand reach or body mobility and cannot otherwise clean themselves and thus provide a measure of dignity and independence not otherwise possible.

It is another object of the present invention to provide a personal hygiene appliance in the form of a hand extension device for use in cleaning the perineal area in which a minimum amount of toilet paper is required for personal cleaning and which is suitable for use with single sheets of premoisturized wipes.

It is a further object of the present invention to provide a personal hygiene appliance in the form of a one-piece hand extension which can be held by one hand without hand squeezing or finger manipulation for the purpose of retaining toilet paper or premoisturized wipes in the device during operation It is still another object of the present invention to provide a personal hygiene appliance with a contoured and flexible cleaning head which grasps single sheets of cleansing tissue in a manner which prevents them from being pulled out of the appliance in the event a person's body parts closes on the tissue and which achieves comfortable and effective cleaning of the perineal area after defecation or urination from both a sitting position and while lying in bed.

And it is yet a further object of the present invention to provide a personal hygiene appliance which permits a one-handed releasing of soiled material from the cleaning head.

Other objects and advantages of the present invention will become apparent when the apparatus of the present invention is considered in conjunction with the accompanying drawings.

DESCRIPTION OF THE PREFERRED EMBODIMENT

Reference is made to the drawings for a description of the preferred embodiment of the present invention wherein like reference numbers represent like elements on corresponding views.

The present invention combines existing premoisturized towelette technology as well as conventional toilet paper with a novel extension handle hygiene appliance as a means of assisting a person in reaching and cleaning the perineal area. The term "tissue paper" as used hereinafter refers to either one or more sheets of toilet paper, premoistened wipes, or any other flexible cleaning material. The present invention will aid people who are unable to reach the perineal area with their hand for purposes of cleaning themselves after elimination due to having limited body mobility or range of motion caused by arthritis, old age, being overweight, having short arms, having back problems, being confined to a bed and using a bedpan, and other conditions.

Figure 1:
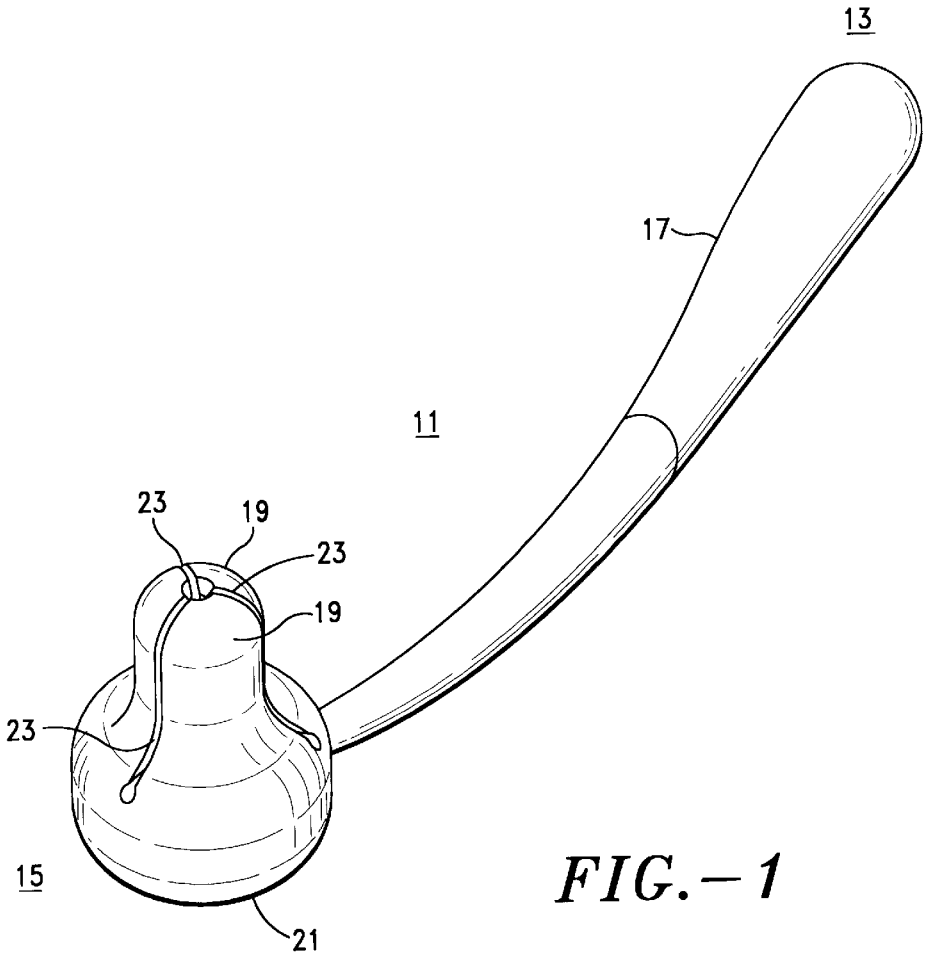
FIG. 1 shows in perspective view a personal hygiene device without a sheet of cleaning material inserted and grasped by the cleaning head.

FIG. 1 shows in perspective view the personal hygiene appliance of the present invention without a sheet of cleaning material disposed on the cleaning head. The personal hygiene appliance extension handle 11 is comprised of a rigid curved structure which accommodates at a first end 13 the user's hand and at the second or other end 15 a cleaning head having a grasping means for temporarily securing the tissue paper thereto. The extension handle is in the form of a curved structure of sufficient length to aid all size persons to reach the perineal area of their bodies. The first end 13 of the extension handle, which is the band grip area 17, is shaped to accommodate the grip of either the right or left human hand, and it permits the appliance to be grasped firmly, without undue effort necessary to prevent twisting, and with natural hand position for manipulating the handle to clean the perineal area.

For people who have limited hand strength or range of motion, the basic grip can be modified to provide a custom fit as is often done with other devices designed for those who have special physical limitations. Thus, in normal use, the hand is maintained in a familiar and comfortable position when employing the hand extension to clean the perineal area. To accommodate different needs, the hand extension may be produced in different lengths or have a means of length adjustment within the handle such as telescoping segments or a slidable handgrip.

The second or opposite end 15 of the extension handle includes a means for grasping the tissue paper. The grasping means supports the paper during contact with the perineal area without hand squeezing or digital manipulation and in a manner which prevents the tissue from being pulled out of the appliance during cleaning of the perineal area in the event a portion of the human body surrounding the area inadvertently experiences closure upon the tissue paper and tends to extract it from the appliance. The second end is also formed to support even a single sheet of the tissue paper spread in a generally rounded configuration to enhance full contact of the perineal area by the tissue paper during the cleaning process. The configuration of the extension handle permits accurate orientation and positioning of the tissue paper proximate the perineal area prior to contact therewith.

The cleaning material is gripped or pinched by a plurality of flexible fingers which together form an incurvate dome-like structure. A sheet of premoisturized material, or several sheets of toilet tissue layered together, are temporarily secured thereto by pushing the center of the sheet, or sheets, into the center of the dome-like structure defined by the plurality of flexible fingers. The flexible fingers are spread slightly apart against a biased closed condition by the material thus inserted and thereby grasp the material from the combined biased force of the fingers acting to come back together to the closed condition. The material not contained within the grip or pinch of the fingers is allowed to drape over the outer surface of the fingers which together create the incurvate dome-like shape of the cleaning head. During use, the material-draped cleaning head is brought into contact with the perineal area of the body for cleaning and manipulated by movement of the hand grip.

The cleaning head is comprised of at least two, and preferably three, flexible fingers 19 which together form the appropriately rounded surface for bringing tissue into contact with the perineal are for cleaning purposes. The fingers are biased toward each other at their distal ends whereby the fingers can be separated by force to permit the insertion of a portion of a tissue paper therebetween. When the fingers are released, they will return to the biased position whereby the tissue is firmly grasped therebetween and retained therein to resist extraction forces which can be imposed thereon by closure forces of the human body portions surrounding the perineal area.

The cleaning head is composed of a slightly flexible material such as a silicone or other synthetic rubber, a natural rubber or other flexible material, and consists of two parts. The first part is a base 21 within which the second end 15 of the extension handle is attached. Preferably, the head is molded in place around the end of the handle to provide a permanent and unitary (one-piece) assembly. Rising out of the base is the plurality of fingers 19, preferably three in number, but any number is possible and considered within the scope of this invention.

The fingers 19 are internally defined by slits 23 which radiate outwards from a hollow cavity 25 centered between the fingers and are made from the same material as the base, but, because of their shape and size, provide the necessary flexibility. The fingers are biased toward each other to form an incurvate dome-like structure that extends out of the base. The fingers are biased by the inherent resiliency of their composition, or each finger may also be fabricated from a metal spring encapsulated in rubber or other soft material secured to the base.

The three fingers radiate out from a central cavity with a slight concave depression at the apex of the incurvate dome-like structure to facilitate pushing the tissue paper into the center cavity. The fingers combined may form other shapes suitable for cleaning the perineal area, or can be shaped and sized to accommodate other areas of the body such as between the toes.

Centered within and parallel with the fingers 19 is the cavity 25 within the top of which the center of the sheet of tissue is inserted. Some tissue material will also be wedged between adjacent fingers. Thus, the combined bias force of the resilient fingers will hold the tissue in place during the act of cleaning the perineal area. Each slit stops near the bottom of the incurvate dome-like structure and radiates out from the center cavity. The angles between slits are equal and in the case of the preferred three-fingered embodiment shown, the FIGS. are 120 degrees apart. The cleaning head is permanently molded around the end of the extension handle to provide a one-piece product.

The cleaning head of the hand extension is moved about the area to be cleaned in similar fashion to using the hand directly, e.g., in a circular or linear wiping motion. The fingers comprising the flexible dome-like structure may deform slightly as they are brought against the body. This action generally tends to increase the grip or pinch on the material held within the fingers comprising the dome, thus preventing the material from being inadvertently released during the act of cleaning. When the cleaning material is soiled, the user simply grasps hold of one corner of the sheet, or sheets, and pulls it from the cleaning head. Alternatively, if the appliance is inverted, the cleaning material will hang downward enclosing the soiled surfaces of the tissue whereby the backsides of the tissue can be grasped to pull it from the appliance. The cycle of wiping the body area and then disposing of the soiled cleaning material can be repeated until the body part is clean.

The cleaning head is attached to the hand extension in such a way to accommodate all personal hygiene preferences, e.g., people who clean themselves from their left or right side, as well as people who prefer to clean themselves from the front or the back.

Figure 2:
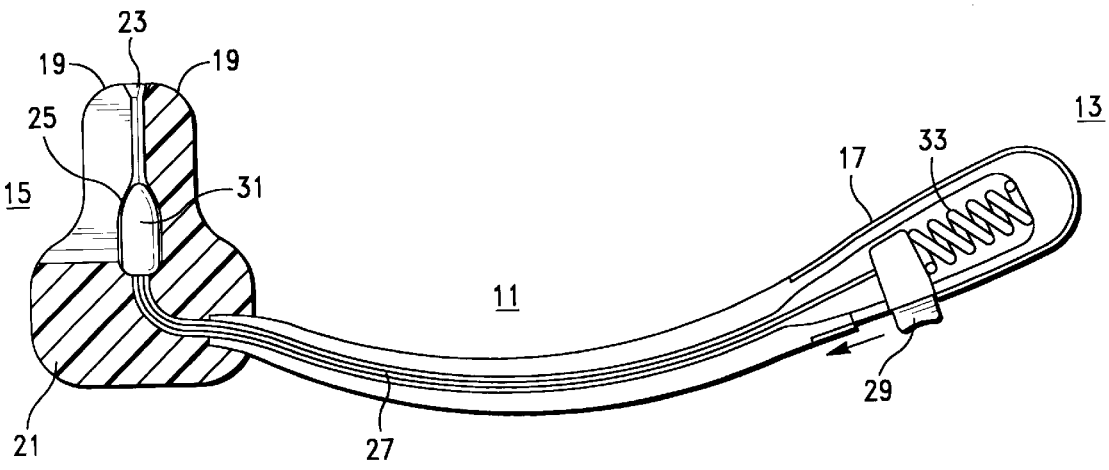
FIG. 2 shows a side elevation in cross section of the personal hygiene device of FIG. 1.
Figure 3:
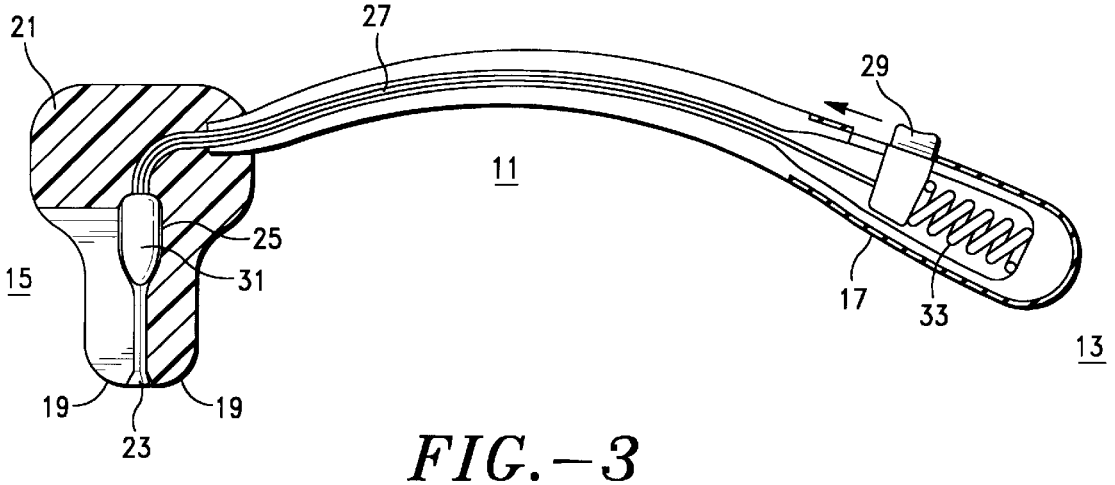
FIG. 3 shows a side elevation in cross section of the cleaning head with a mechanism for ejecting cleaning tissue from the cleaning head.
Figure 4:
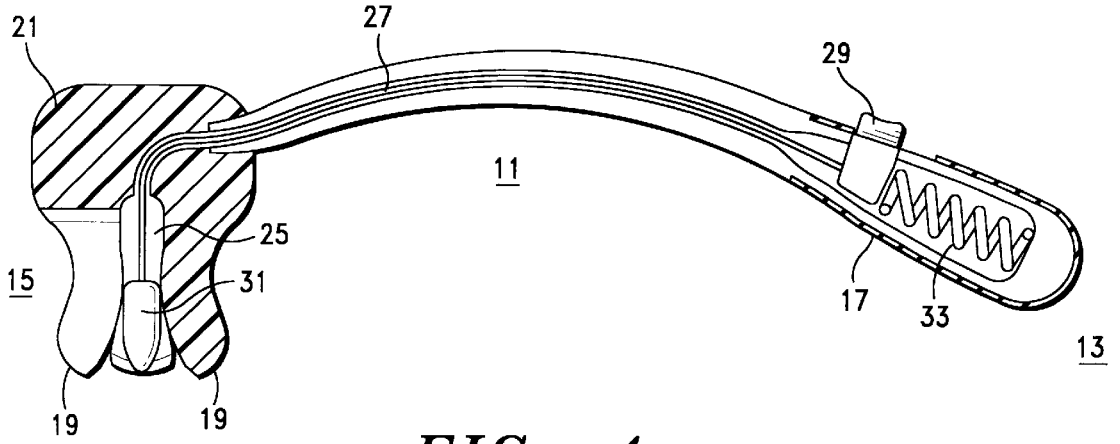
FIG. 4 shows FIG. 3 in cleaning material eject mode.

FIG. 2 shows in cross section the extension handle with a thumb-activated release system for ejecting soiled tissue which is manipulated from the hand grip 17 The invention in the simplest form does not include the release system: It is fully functional without it. A flexible pushrod 27 is disposed internally of the handle and is reciprocated through a hollow core in the handle by sliding an attached slide button 29 with the thumb. At the other end of the pushrod is a piston-like structure 31 that is located internally of the fingers 19 in the center of the base 21 and at the bottom of the center cavity 25. Actuation of the slide button toward the cleaning head causes the pushrod to reciprocate the piston in the center cavity to spread the fingers and thereby eject any cleaning material that is held between the fingers. When the button is released, a spring bias return 33 causes the piston to retract back into the base at the bottom of the center cavity and the button to return to its normal or retracted position.

Thus, in summary, a new and novel apparatus for cleaning the perineal area in cases where reach is limited due to physical conditions is provided, and it will be obvious that the stated objects of the present invention are achieved. A flexible cleaning head, requiring a minimum amount of tissue provides effective, economic, and comfortable personal hygiene benefits not realized by the prior art. The present invention eliminates the need to squeeze a pair of tongs or actuate a clamp for the purpose of attaching cleaning material such as toilet paper. Less cleaning material is needed with the present invention and more of the cleaning material is conveniently and properly positioned for cleaning the body.

It will be apparent from the foregoing description of the invention in its preferred form that it will fulfill all the objects and advantages attributable thereto. While it is illustrated and described in considerable detail herein, the invention is not to be limited to such details as have been set forth except as may be necessitated by the appended claims.

We claim:

1. A personal hygiene appliance for persons having limited hand reach or body mobility which functions as a hand extension to permit said persons to clean their perineal area with a firmly grasped tissue paper in a preferred orientation at an extended position from the hand after defecation or urination, said appliance comprising a rigid extension handle having formed at a first end thereof a hand grip for accurately extending and positioning said tissue paper proximate said perineal area prior to contact therewith and at the second opposite end thereof a means for grasping said tissue paper, said handle and said grasping means being formed and interconnected with a curvature to position said grasping means at an orientation approximately at a right angle to said hand grip, said grasping means being comprised of at least two flexible fingers which are inherently biased toward each other and form a partially generally spherical surface at their distal ends whereby said fingers can be separated by force to permit the insertion of a portion of a tissue paper therebetween and when said fingers are released to return to said partially spherical biased configuration whereby said tissue paper is firmly grasped therebetween and is retained therein and thereon to resist extraction forces which can be imposed upon said tissue paper by closure forces of the human body portions surrounding said perineal area, said fingers being formed of a molded flexible material having a base secured to said handle and said fingers secured to and projecting from said base to combine into a rounded partially generally spherical projection when disposed in said biased position.

2. The personal hygiene appliance of claim 1 including means for mechanically separating said fingers by remote actuation from said hand grip by single hand operation.

3. A personal hygiene appliance for persons having limited hand reach or body mobility which functions as a hand extension to permit said persons to clean their perineal area with a firmly grasped tissue paper in a preferred orientation at an extended position from the hand after defecation or urination, said appliance comprising a rigid extension handle having formed at a first end thereof a hand grip for accurately extending and positioning said tissue paper proximate said perineal area prior to contact therewith and at the second opposite end thereof a means for grasping said tissue paper, supporting said paper for opposing contact with said perineal area without hand squeezing or digital manipulation and in a manner which prevents said paper from being pulled out of said appliance during said cleaning of said perineal area in the event a portion of the human body surrounding said perineal area inadvertently experiences closure upon said tissue and tends to extract said tissue from said appliance, said handle and said grasping means being formed and interconnected with a curvature to position said grasping means at an orientation approximately at a right angle to said hand grip said grasping means being formed of a molded flexible material having a base secured to said handle and forming at least two flexible fingers which are biased toward each other at their distal ends whereby said fingers can be separated by force to permit the insertion of a portion of a tissue paper therebetween and when said fingers are released to return to said biased position whereby said tissue paper is firmly grasped therebetween, said distal ends of said fingers being formed to combine into a partially rounded projection when disposed in said biased position and to support at least a single sheet of said tissue paper spread in a generally rounded configuration to enhance full contact of said perineal area by said tissue paper during said cleaning operation, means for mechanically separating said fingers by remote actuation from said hand grip including a flexible pushrod disposed internally of said extension handle and attached to a control button disposed in said hand grip formed for single hand operation while holding said appliance to reciprocate said pushrod in said handle and a piston secured to the opposite end of said pushrod and disposed internally of said fingers in said second end whereby actuation of said control button reciprocates said piston to spread said fingers to eject tissue paper secured therebetween.

4. The personal hygiene appliance of claim 3 wherein said pushrod and piston are spring biased in the retracted position.

* * * * *